US006374643B2

(12) United States Patent
Orima

(10) Patent No.: US 6,374,643 B2
(45) Date of Patent: Apr. 23, 2002

(54) COMPOSITE THREAD CONTAINING METAL-PLATED YARNS AND WARP-KNIT FABRIC THEREOF

(75) Inventor: Hajime Orima, Gumma (JP)

(73) Assignee: Firster Co., Ltd., Gumma (JP)

( * ) Notice: Subject to any disclaimer, the term of this patent is extended or adjusted under 35 U.S.C. 154(b) by 0 days.

(21) Appl. No.: 09/471,813

(22) Filed: Dec. 21, 1999

Related U.S. Application Data

(63) Continuation of application No. PCT/JP99/02303, filed on Apr. 28, 1999.

(30) Foreign Application Priority Data

May 1, 1998 (JP) ..... 10-122050

(51) Int. Cl.[7] ..... D04B 23/08
(52) U.S. Cl. ..... 66/193; 66/192; 66/1 R
(58) Field of Search ..... 66/1 R, 84 R, 66/203, 87, 169 R, 170, 190, 192, 195, 202, 193; 57/212, 220

(56) References Cited

U.S. PATENT DOCUMENTS 1,860,030 A * 5/1932 Hinchliff ..... 66/1
2,541,499 A * 2/1951 Carney ..... 66/1
2,541,500 A * 2/1951 Carney ..... 66/1
3,748,874 A * 7/1973 Blezard ..... 66/1
4,684,762 A 8/1987 Gladfelter
5,603,514 A * 2/1997 Jencks et al. ..... 66/202

FOREIGN PATENT DOCUMENTS

JP 61-27085 2/1986
JP 61-275441 12/1986

* cited by examiner

*Primary Examiner*—Danny Worrell
(74) *Attorney, Agent, or Firm*—Wallenstein & Wagner, Ltd.

(57) ABSTRACT

A thread and a fabric are provided which are capable of being dyed to have a desired color and are formed of a metal-plated yarn excellent in antibacterial and electro-magnetic shielding properties. The thread for achieving this object is a composite thread (1) consisting of a chain stitch yarn (3) formed of a dyeable yarn and a metal-plated yarn (2) inserted as a core yarn into the chain stitch yarn (3). A fabric or a weft-knit product formed of the composite yarn (1) is excellent in antibacterial and electro-magnetic shielding properties and capable of having a favorable appearance of desired color. If the metal-plated yarn is directly arranged in the warp-knit fabric, the metal-plated yarn (51, 52, 53, 54) is preferably inserted to be invisible to a human eye from the surface of the warp-knit fabric.

8 Claims, 8 Drawing Sheets

COMPOSITE THREAD CONTAINING METAL-PLATED YARNS AND WARP-KNIT FABRIC THEREOF

This application is a Continuation of International Application No. PCT/JP99/02303, filed Apr. 28, 1999 (claiming priority from Japanese Appln. No. 10-122050, filed May 1, 1998), now pending (which is hereby incorporated by reference).

TECHNICAL FIELD

The present invention relates to a composite thread comprised of metal-plated yarns having an antibacterial property and an electromagnetic shielding property combined with dyeable yarns so that the former are not visible from the outside, a woven fabric or a weft-knit fabric containing such composite threads, and a warp-knit fabric wherein the metal-plated yarns are used alone as part of the knit fabric, while taking care not to expose outside the thread.

PRIOR ART

The recent trend of requiring an improvement in the quality of life demands amenities in the environment. Particularly, in a high-temperature and high-humidity environment such as in Japan, various bacteria are liable to damage the health life or generate a bad odour. Therefore, underwear or others are often treated with antibacterial agents.

On the other hand, as the electronic technology has developed, various electronic equipments such as TV sets, word processors or personal computers, which scatter electromagnetic waves therefrom, have come into wide use at work or in the home, resulting in a problem of potential physical problems due to irradiation with electromagnetic waves.

The antibacterial agents used nowadays are roughly classified into three types; the first one is of metallic particle type or a metal-containing inorganic particle type; the second one includes various organic compounds; and the third one includes animal-type polymeric compounds such as chitin or chitosan; which may be applied to a surface of a textile product or contained in fibers composing the textile product.

The antibacterial property may vary in accordance with the conditions under which the target textile product is used and laundered. Also, if a hygienic and safety standpoint is taken into account, there is no antibacterial agent sufficiently effective for all the textile products. Particularly, antibacterial agents excellent in durability and applicable to various uses have not yet been found.

As for a countermeasure against electromagnetic waves, it is preferable to basically prevent the electronic equipment leaking electromagnetic waves. It is, however, impossible to apply effective electromagnetic shielding to all electronic equipment of various types. Accordingly, it is convenient for a user of the electronic equipment to wear clothing having an electromagnetic shielding property. For example, clothing made of a cloth with a coated layer containing powdery metal is prepared for this purpose. The clothing made of the cloth with the coated layer containing powdery metal, however, is heavy in weight and is actually difficult to dye in the various colors desired for apparel.

Fibers containing powdery metal are excellent in durability both of the antibacterial property and electromagnetic shielding property. However, the metal-containing fibers obtained by kneading a thermoplastic resin with metallic particles and melt-spinning the same could not exhibit a sufficient antibacterial property because the metallic particles are embedded in the fibers. The maximum content of metal in the fiber obtainable by a high-speed melt spinning process is as low as about 0.5% which results in poor antibacterial and electromagnetic shielding properties. While a 100% metallic yarn made, for example, of silver or copper; i.e., a metallic wire; has sufficient antibacterial and electromagnetic shielding properties, it is not usable as a yarn for forming clothing due to its poor pliability.

Thus, a yarn having a metallic layer of silver or copper on a surface thereof; that is, a metal-plated yarn; is expected to be desirable for a yarn excellent in antibacterial property or electromagnetic shielding property. A silver-plated polyamide yarn (X-Static, a trade mark) of this kind is marketed by Sauquoit Co., of the United States. The antibacterial property and electromagnetic shielding property of this yarn are extremely excellent. However, there is a problem when this yarn is used alone or in combination with another synthetic yarn as a twisted yarn.

That is, textile products, particularly clothing products, must be dyed in desirable colors. The X-Static® yarn, however, inherently has a silver color on the surface thereof and is not dyeable to desired colors as in conventional natural or synthetic fiber yarns. If twisted with another synthetic yarn, the resultant yarn is unevenly dyed. In addition, if the yarn is used while always maintaining the metal in an exposed state, the metal is abraded to interfere with the long term maintenance of the antibacterial property and the electromagnetic shielding property. The problem in dyeing is also accompanied when the X-Static® yarn is mixedly used in a woven fabric or a knit fabric in the conventional manner.

An object of the present invention is to provide a composite thread, of a unique structure containing metal-plated yarns, which is dyeable to desirable colors while exhibiting the excellent antibacterial property and the electromagnetic shielding property inherent to the metal-plated yarn, a fabric using such a composite thread, and a fabric dyeable in desired colors even though it contains metal-plated yarns, wherein the metal-plated yarns are not exposed outside the surface of the fabric to be invisible to a human eye so that the desired antibacterial property and electromagnetic shielding property are stably maintained in a desired extent at a relatively low cost.

DISCLOSURE OF THE INVENTION

The above-mentioned object of the present invention is achievable by a composite thread comprising a chain stitch yarn and an inlay yarn inserted as a core yarn into the chain stitch yarn, characterized in that the inlay yarn contains at least one metal-plated yarn.

A woven fabric or a weft-knit fabric according to the present invention may be obtained by using the composite thread as part thereof.

When a warp-knit fabric is obtained by using the metal-plated yarn itself, the metal-plated yarn may be inserted as an inlay yarn into the warp-knit fabric to be invisible to a human eye from the surface of the warp-knit fabric. If two kinds or more of metal-plated yarns are supplied through different reeds so that the different kinds of metal-plated yarns intersect each other in the warp-knit fabric, the electroconductivity of the metal-plated yarns is improved to facilitate the electro-magnetic shielding property of the warp-knit fabric.

Silver has the best antibacterial property of various metals. Accordingly, the metal-plated yarn in the composite thread of the present invention is preferably a silver-plated yarn.

A kind of a raw material yarn to be plated with metal may be properly selected in accordance with uses of the resultant textile products using the composite thread of the present invention.

A type of the raw material yarn may be a monofilament yarn, a multifilament yarn or a spun yarn formed of staple fibers. In either case, a weight ratio of metal to be plated is preferably in a range from 20% to 40% relative to a total weight of fibers composing the yarn.

If a fabric such as a woven fabric, a circular knit fabric or a warp-knit fabric, or a weft-knit product such as a sock, a stocking or a sweater is made from the composite thread according to the present invention, it is possible to provide a fabric or a textile product excellent in antibacterial property and electro-magnetic shielding property. At that time, the composite thread or the fabric according to the present invention may be partially used in accordance with uses of the fabric, the product made thereof or the weft-knit product.

The composite thread according to the present invention has the same structure as those disclosed in Japanese Patent Application No. 7-271200 filed on Oct. 19, 1995 with the title "Composite Thread Having Stretchability and Luster" and published on Apr. 28, 1997 as Japanese Unexamined Patent Publication No. 9-111624, and in Japanese Patent Application No. 7-271194 filed on Oct. 19, 1995 with the title "Composite Thread for Embroidery Lace" and published on Apr. 28, 1997 as Japanese Unexamined Patent Publication No. 9-111633, both of which have been filed in the name of the Applicant of the present application. Specifically, in the thread of the former application, a chain stitch yarn is formed of a non-stretchable filament yarn, while an inlay yarn is formed of a stretchable yarn, so that a thread high in stretchability as well as luster is obtainable. On the other hand, in the thread of the latter application, a chain stitch yarn is formed of a non-stretchable yarn soluble in an aqueous solvent or destructible by heat, while an inlay yarn is formed of a stretchable yarn, so that no defects occur during the embroidery operation, such as yarn breakage, and the stretchability is imparted to an pattern area of the embroidery lace, corresponding to that of a embroidered fabric after the completion of the embroidery operation. This means that the kinds of yarn used in the present invention and effects resulted therefrom are different from those of the above-mentioned known composite threads, and further, the known composite threads have no antibacterial and electro-magnetic shielding properties and provide no means for improving the dyeability thereof which has been deteriorated by the use of metal-plated yarns.

According to the present invention, a composite thread wherein an inlay yarn containing at least one metal-plated yarn is inserted into a chain stitch yarn of a dyeable type is obtained by supplying a dyeable yarn and an inlay yarn containing at least one metal-plated yarn via different yarn guides, respectively, to needles of a warp knit machine, subjecting the yarn guide for the dyeable yarn to a reciprocating motion of a chain stitch formation mode to form the chain stitch yarn, and simultaneously therewith, subjecting the yarn guide for the inlay yarn to a reciprocating motion in an inlay yarn formation mode.

During the above-mentioned process, the chain stitch yarn may be formed by using at least two dyeable yarns, and the inlay yarn may be formed not only of the metal-plated yarn but also of one or more fibrous yarns of other kinds which are optionally selected in accordance with uses of the resultant composite thread.

In the composite thread according to the present invention, since the inlay yarn containing the metal-plated yarn is entangled with loops of the chain stitch yarn comprised of dyeable yarn, no metal-plated yarn substantially projects out of the surface of the composite thread. Also, it is possible to prevent the metal-plated yarn from being exposed on the surface of the composite thread by suitably select the thickness of the dyeable yarn and the number of stitches per unit length of the chain stitch yarn, whereby the damage of the metal-plated yarn due to friction is avoidable and the uniform dyeing of the composite thread is obtainable.

However, the metal-plated yarn itself is expensive, and the composite thread formed of such a metal-plated yarn becomes more expensive. In this regard, the present inventor has discovered, based on an idea that if the metal-plated yarns themselves are properly distributed in a fabric of a special structure as a part thereof, that it would be possible to obtain the antibacterial property and the electro-magnetic shielding property as high as equal to those resulting from the use of the composite thread, and to conceal the metal-plated yarns in the fabric structure to be invisible to a human eye from the outside, whereby both the durability of the metal-plated yarn and the uniformity in dyeing of the fabric are enhanced. As a result, it has been found that such requirements are achievable by a warp-knit fabric as described below.

The warp-knit fabric according to the present invention uses two kinds of yarns or more, and is characterized in that at least one kind of yarn is a metal-plated yarn inserted into a structure of the fabric to be indiscernible by a human eye from the surface of the fabric. If the metal-plated yarn is disposed as an inlay yarn, the inlay yarn is not entangled with other yarns constituting the warp-knit fabric, but extends substantially linearly in the warp or weft direction of the warp-knit fabric to equalize the antibacterial property or the electro-magnetic shielding property in a predetermined section of the warp-knit fabric. Also, since the inlay yarn may be located inside the warp-knit fabric, this serves to improve the above-mentioned color irregularity or maintaining the antibacterial property for a long term. In this regard, when the fabric is used in the field requiring the electro-magnetic shielding property, the metal-plated yarns are preferably arranged to intersect each other.

When the warp-knit fabric is of a net type used as a ground structure for a power net or others, such a net type warp-knit fabric is embroidered with an embroidery thread to be an embroidery lace, from which is preferably formed a lady's underwear such as a brassiere. In such a manner, the underwear excellent in antibacterial property as well as electro-magnetic shielding property is obtainable.

The metal-plated yarn used in the present invention is also excellent in anti-static property. Thus, a composite thread, fabric formed of the composite thread and a warp-knit fabric containing a metal-plated yarn result in splendid effects on the antibacterial property and the electro-magnetic shielding property as well as the anti-static property.

BRIEF DESCRIPTION OF THE DRAWINGS

FIG. 1 illustrates one example of a composite thread according to the present invention, wherein FIG. 1(A) is a stereographic view of a structure of the thread, and FIG. 1(B) is a threading diagram thereof;

FIG. 2 illustrates another example of a composite thread according to the present invention, wherein FIG. 2(A) is a stereographic view of a structure of the thread, and FIG. 2(B) is a threading diagram thereof;

FIG. 3 illustrates a further example of a composite thread according to the present invention, wherein FIG. 3(A) is a stereographic view of a structure of the thread, and FIG. 3(B) is a threading diagram thereof;

BEST MODES FOR CARRYING OUT THE PRESENT INVENTION

Figure 1:
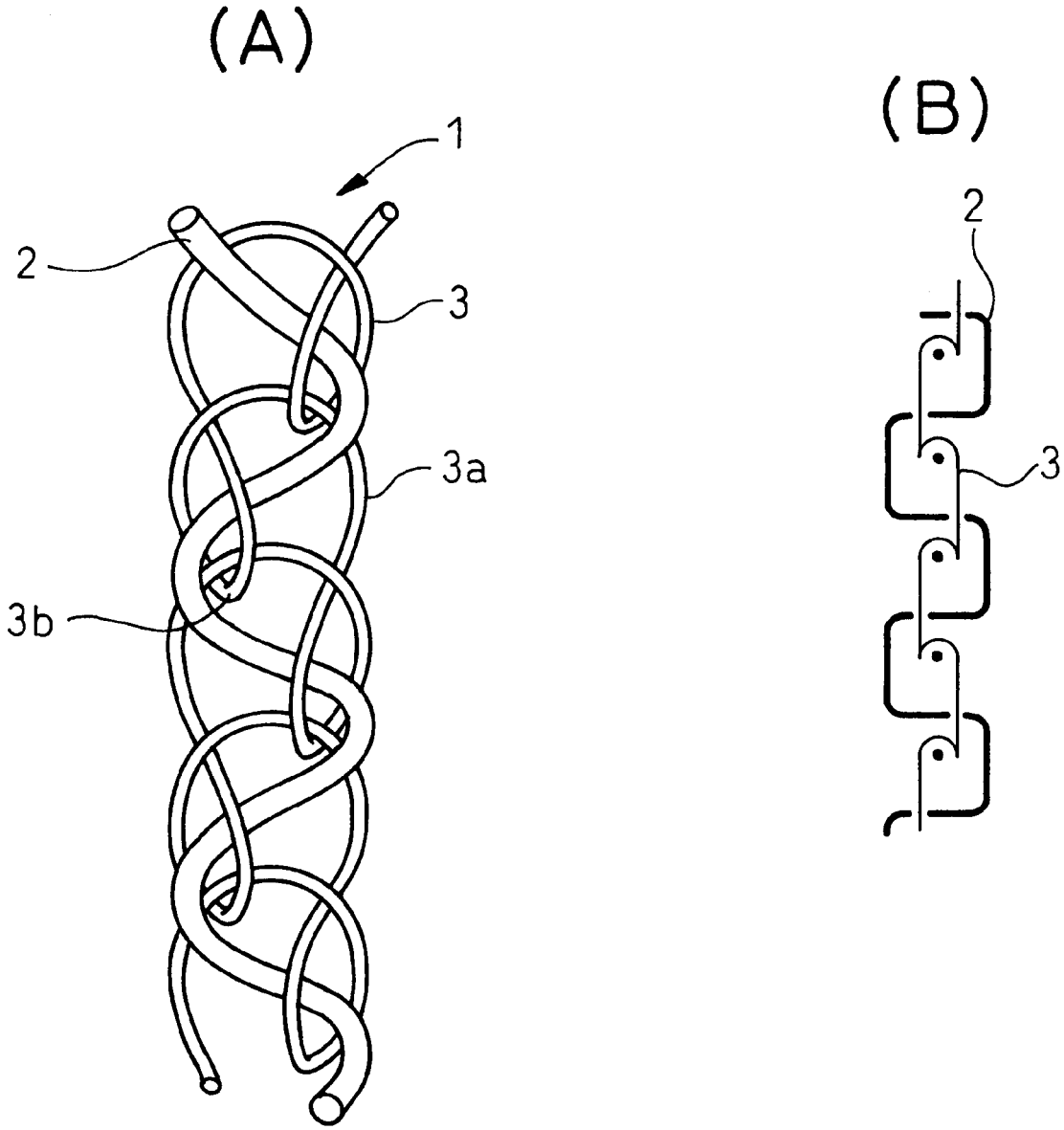

A structure of a composite thread of the present invention will be described with reference to the attached drawings illustrating one example thereof. A composite thread 1 is shown in FIG. 1(A) wherein an inlay yarn 2 is normally inserted into an open loop of a chain stitch yarn 3; a composite thread 1*a* is shown in FIG. 2(A) wherein an inlay yarn 2*a* is reversely inserted into an open loop of a chain stitch yarn 3; and a composite thread 11 is shown in FIG. 3(A) wherein an inlay yarn 12 is normally inserted into a closed loop of a chain stitch yarn 13. Note that FIGS. 1(A), 2(A) and 3(A) are stereographic views of a thread structure, respectively, illustrating that the inlay yarn is comprised of a metal-plated yarn knitted to the chain stitch yarn comprised of a dyeable yarn and that, in the actual composite thread thus obtained, the inlay yarn linearly extends and the loop of the chain stitch yarn deforms in conformity therewith to be different from the illustrated one.

Whether the open loop or the closed loop is used for forming the chain stitch yarn or whether the inlay yarn is normally or reversely inserted may be optionally determined in accordance with uses of the composite thread, kind of the yarn adopted, or knitting conditions.

In either of the composite threads shown in FIGS. 1(A), 2(A) and 3(A), the chain stitch yarn 3, 13 includes a yarn portion 3*a*, 13*a* extending in the axial direction of the composite thread 1, 1*a*, 11 and another yarn portion 3*b*, 13*b* loopingly intersecting the adjacent loop. On the other hand, the inlay yarn 2, 2*a*, 12 extends in the axial direction of the composite thread 1, 11 while passing through the loops of the chain stitch yarn 3, 13. Consequently, there is provided a yarn structure wherein the inlay yarn 2, 2*a*, 12 is encompassed like a core yarn by the chain stitch yarn 3, 13 and is entangled therewith. Thus, the loops of the chain stitch yarn 3, 13 constricts the inlay yarn 2, 2*a*, 12. Magnitude and pitch of the constriction and elongation of the composite thread 1, 1*a*, 11 are freely controllable in accordance with uses of the composite thread 1, 1*a*, 11 by the adjustment of a feed rate of the dyeable yarn used for the chain stitch yarn 3, 13 during the manufacturing process.

FIGS. 1(B), 2(B) and 3(B) illustrate threading diagrams, respectively, corresponding the above-mentioned composite threads.

As dyeable yarns, spun yarns, multifilaments and monofilaments may be employed.

The spun yarns include those of natural fibers such as cotton, wool or ramie; those of artificial staple fibers such as viscose; and those of various synthetic fibers, which may be used alone or combined with each other.

The filaments include those of viscose rayon, cupra-ammonium rayon, acetate rayon or various synthetic fibers.

Kinds and thicknesses of such dyeable yarns may be properly selected in accordance with uses of the composite thread.

Metal used for the metal-plated yarn includes silver, copper, zinc, lead, tin, aluminum, iron or others. Although expensive, gold may be used in a special case. Plating may be carried out by a vacuum plating or a gas-phase plating corresponding to the metal to be used. A raw yarn to be metal-plated may be any synthetic fiber such as polyamide or polyester, or inorganic fibers such as glass.

A thickness of the metal-plated yarn may be determined in accordance with uses of the composite thread of the present invention. For example, in a silver-plated yarn, a monofilament or multifilament of a thickness from 10 d to 110 d is used, wherein the content of silver in the resultant metal-plated yarn is in a range from 20% to 40% by weight.

The metal-plated yarn may be used together with another dyeable yarn to form an inlay yarn. In such a case, the dyeable yarn used is preferably of the same kind as that of the chain stitch yarn.

A ratio of the metal-plated yarn in the composite thread may be selected by primarily taking the antibacterial and electro-magnetic shielding properties into account, which is required for the product in which the composite thread is used, and secondarily taking the resistance to abrasion and the dyeability of the above-mentioned metal-plated yarn into consideration.

Since the antibacterial property of the metal-plated yarn is, in general, extremely high as shown in Examples described later, a weight of the metal-plated yarn in a final product may be relatively small if the product is applied to the use wherein the antibacterial property is mainly required. Therefore, a wide selection is possible such that the composite thread according to the present invention may be arranged in the product at a large pitch, for example, one per several conventional yarns.

Next, fabrics and weft-knit products will be described below, using the composite yarns having the antibacterial property according to the present invention.

As described above, the composite thread according to the present invention is excellent in antibacterial property and is capable of substantially eliminating the difference in color when a fabric or the like using the composite thread is dyed, between the same and a remaining portion. Accordingly, it is possible to optionally select various types of fabrics such as woven fabrics, warp-knit fabrics, or weft-knit products such as socks, stockings, sweaters or others so that antibacterial fabrics using the composite thread are provided.

Figure 4:
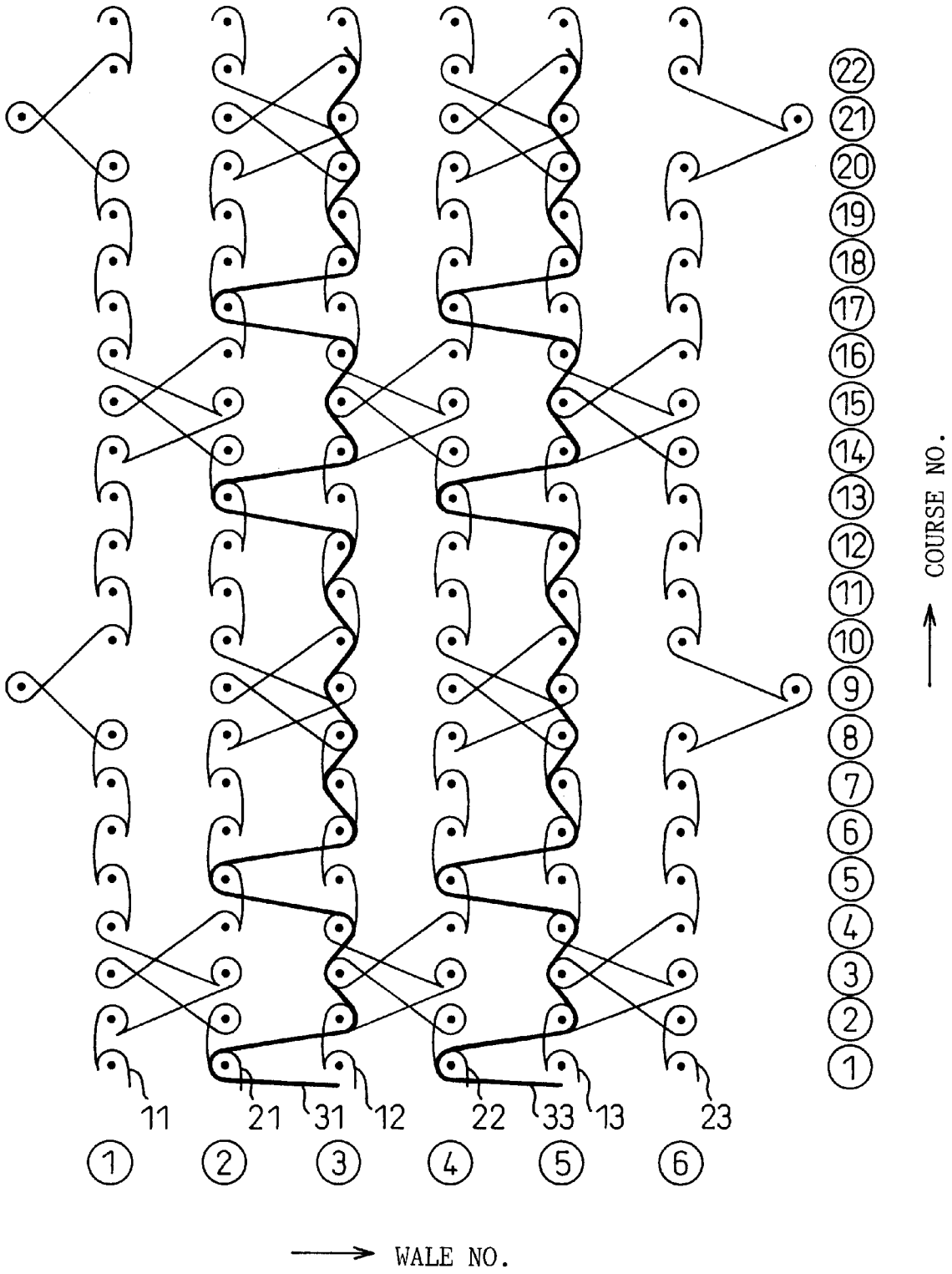
FIG. 4 is a threading diagram of one example of a warp-knit fabric using a composite thread according to the present invention.

As one example of a fabric using the composite thread according to the present invention, a threading diagram for a six-course net warp-knit fabric is shown in FIG. 4.

In the drawing, a group of yarns 11, 12 and 13 are supplied from one reed, and another group of yarns 21, 22 and 23 are supplied from another reed, whereby a net warp-knit fabric is formed of these conventional yarns. On the other hand, yarns 31 and 33 indicated by a thicker solid line in the drawing are the composite threads and inserted into the net warp-knit fabric. In FIG. 4, while the composite yarns 31 and 33 are inserted into the warp-knit fabric in wales ③ and ⑤, respectively, they may be in wales ③ and ⑥, respectively. In the latter case, an amount of the metal-plated yarn used in a unit area of the knit fabric could be reduced to two thirds in comparison with the former case.

Figure 5:
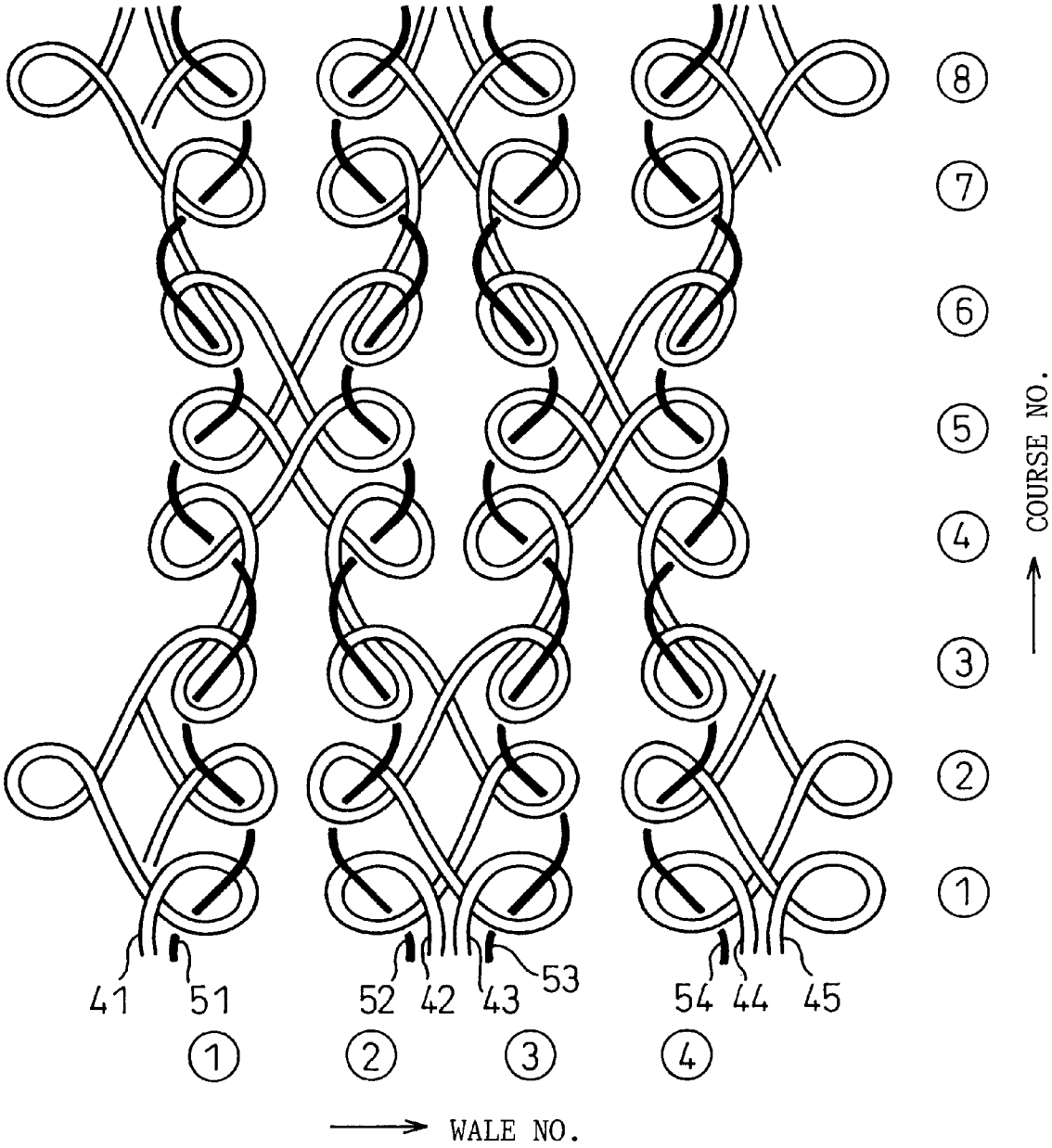
FIG. 5 is a threading diagram of one example of a warp-knit fabric using a metal-plated yarn directly as an inlay yarn according to the present invention.

FIG. 5 shows a threading diagram for another example of a warp-knit fabric according to the present invention wherein the metal-plated yarns are directly inserted as inlay yarns into the fabric. In the warp-knit fabric shown in FIG. 5, dyeable yarns 31, 42, 43, 44 and 45 are knitted with each other in accordance with the threading diagram illustrated to form the fabric. Metal-plated yarns 51, 52, 53 and 54 are inserted into the knit fabric to extend in the longitudinal direction of the warp-knit fabric while simply meandering leftward and rightward.

Figure 2:
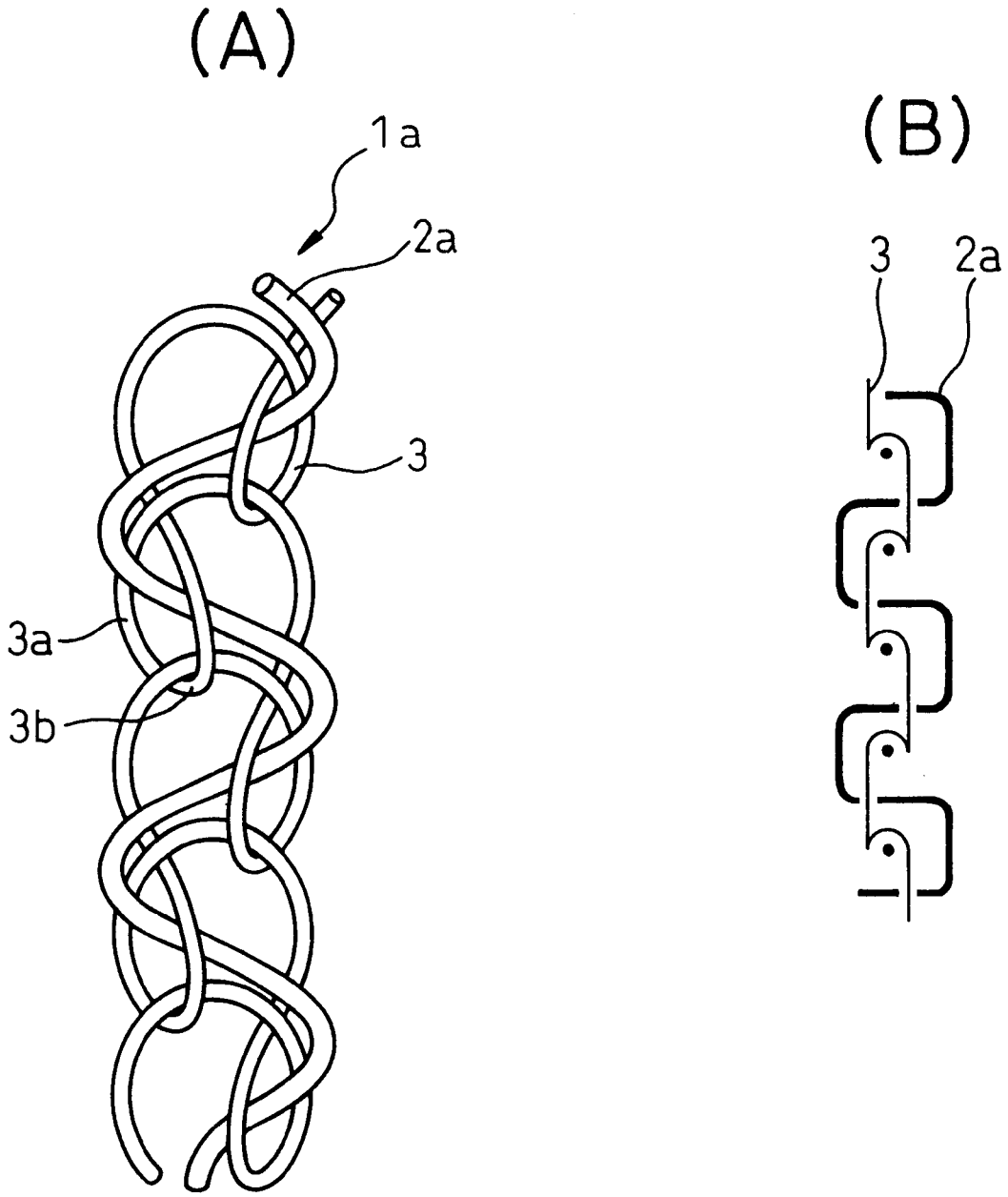
Figure 3:
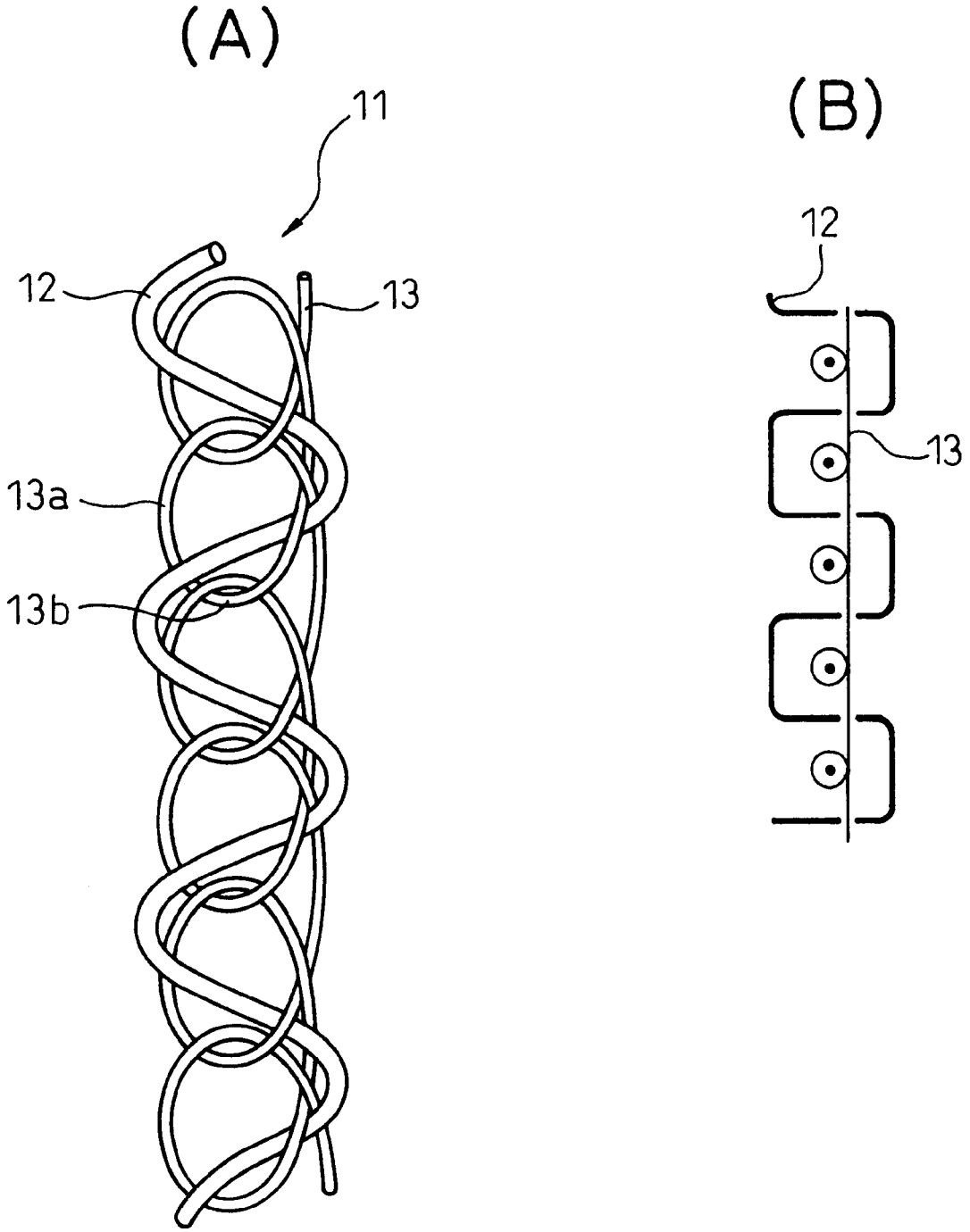

As apparent from the comparison of the threading diagram shown in FIG. 5 with the composite threads shown in FIGS. 1 to 3, it is deemed that the warp-knit fabric of FIG. 5 is a net warp-knit fabric wherein the composite threads are arranged in parallel to each other in the wale direction and thereafter every adjacent two composite threads are interconnected by the dyeable yarns.

Since the metal-plated yarns are inserted in the warp-knit fabric according to such a structure, the metal-plated yarns are invisible to a human eye on the surface of the warp-knit fabric. This is particularly useful when the dyeable yarn is dyed with cationic dye since the metal-plated yarns are not conspicuous even after dying.

Figure 6:
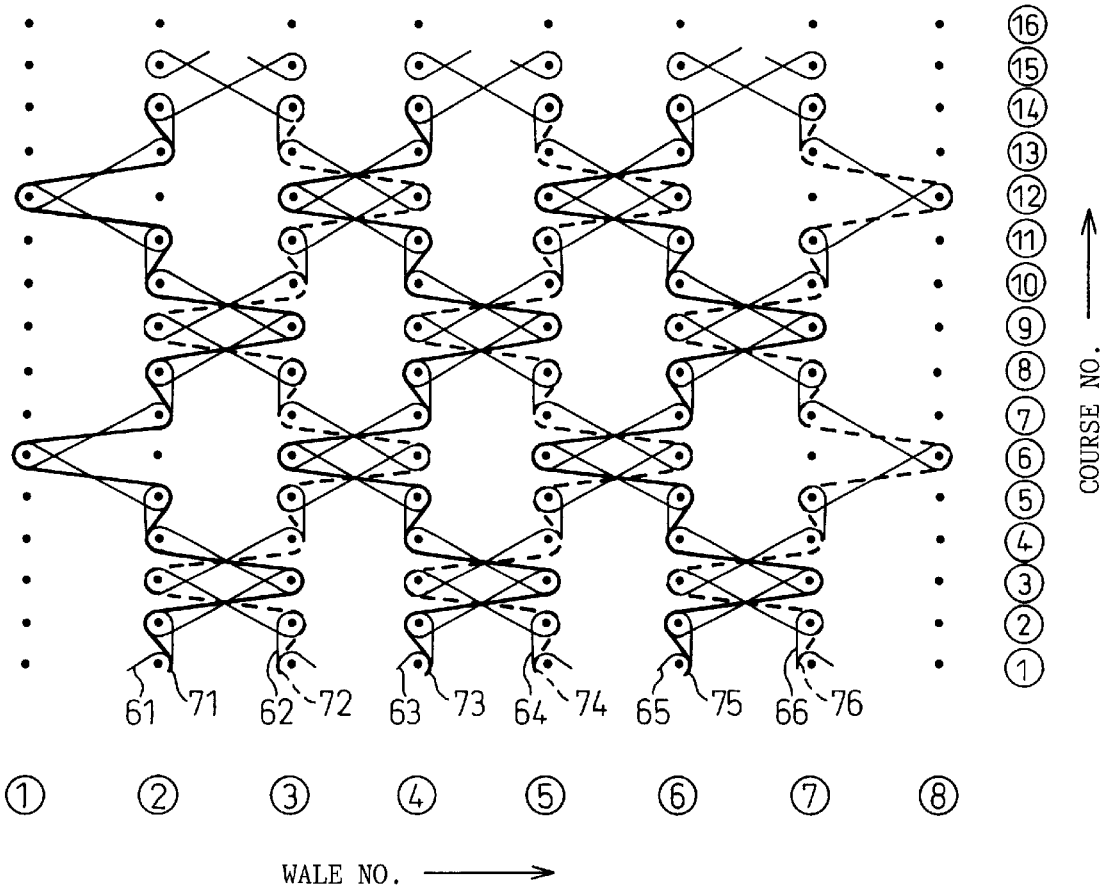
FIG. 6 is a threading diagram of another example of a warp-knit fabric using a metal-plated yarn directly as an inlay yarn for the purpose of improving the electro-magnetic shielding property according to the present invention.

FIG. 6 illustrates a threading diagram for a further example of a warp-knit fabric according to the present invention favorably applied to the use in which the electro-magnetic shielding property is mainly demanded, wherein the metal-plated yarns are directly used as inlay yarns.

Yarns 61, 63 and 65 indicated by a thinner solid line in the drawing are a group of dyeable yarns supplied from one reed; and yarns 62, 64 and 66 also indicated by a thinner solid line are another group of dyeable yarns supplied from another reed. The dyeable yarns 61, 63 and 65 are knitted mirror-symmetrically with the dyeable yarns 62, 64 and 66, as illustrated, to form a net warp-knit fabric. In the drawing, a group of yarns 71, 73 and 75 indicated by a thicker solid line are metal-plated yarns supplied from one reed, and another group of yarns 72, 74 and 76 indicated by a thicker broken line are metal-plated yarns supplied from another reed. The metal-plated yarns 71, 73 and 75 are inserted together with the metal-plated yarns 72, 74 and 76 into the net warp-knit fabric formed of the dyeable yarns as illustrated.

One of features of the warp-knit fabric illustrated in FIG. 6 resides in that the group of metal-plated yarns 71, 73 and 75 intersect the other group of metal-plated yarns 72, 74 and 76 within the fabric structure. Since the surface of the metal-plated yarn is coated with metal as described above, it is possible to electrically connect substantially all the metal-plated yarns in the warp-knit fabric to each other by intersecting the adjacent metal-plated yarns each other, whereby the electro-magnetic shielding property is further improved.

Also, as apparent from FIG. 6, since the metal-plated yarns are inserted to be concealed by all the loops of the net warp-knit fabric formed of the dyeable yarns, the metal-plated yarns are invisible to a human eye in the warp-knit fabric shown in FIG. 6. Further, since the maximum amount of metal-plated yarns is distributed in a predetermined area of the net warp-knit fabric, it is possible to improve the electro-magnetic shielding property. Note that the warp-knit fabric shown in FIG. 6 may be used in a field necessitating the antibacterial property because the metal-plated yarn has the antibacterial property.

Figure 7:
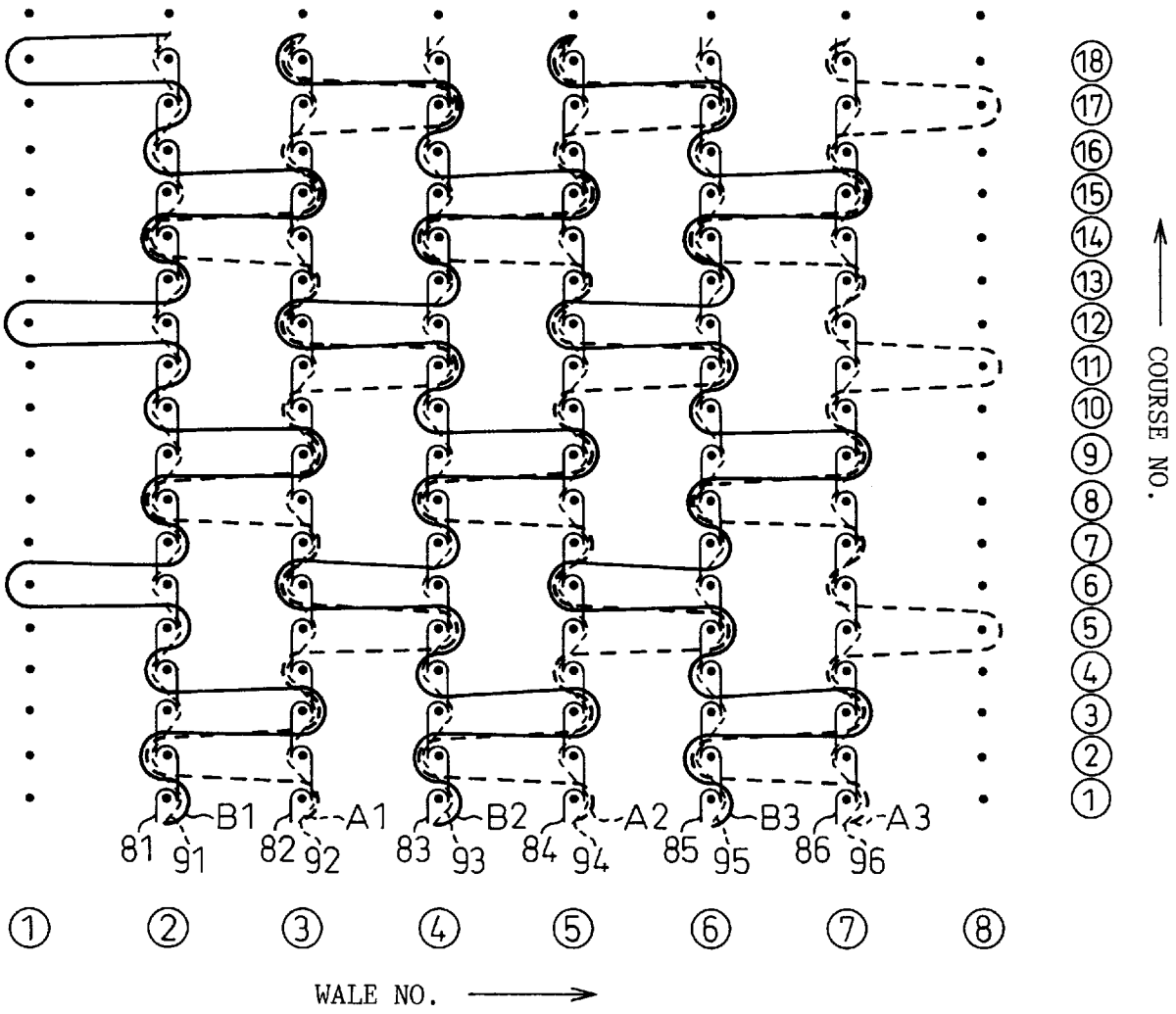
FIG. 7 is a threading diagram of one example of a warp-knit fabric using a composite thread directly as an inlay yarn for the purpose of improving the electro-magnetic shielding property according to the present invention.

FIG. 7 illustrates a threading diagram of a further example of a warp-knit fabric, according to the present invention, wherein the composite thread of the present invention is used as an inlay yarn.

In the drawing, yarns 81 to 86 indicated by a thinner solid line are dyeable yarns supplied from one reed, each being chain-knitted in the respective wale. Yarns 91 to 96 indicated by a thinner broken line are elastomeric yarns supplied from another reed, each being inserted into the chain stitch of the dyeable yarn while meandering rightward and leftward in the respective wale. Yarns A1 to A3 indicated by a thicker broken line and yarns B1 to B3 indicated by a thicker solid line are the composite threads according to the present invention supplied from different reeds, respectively, to be inserted as illustrated. Since the elastmeric yarns 91 to 96 are used in this warp-knit fabric, the fabric is stretchable in the wale direction. The composite thread is used for connecting the chain-stitched dyeable yarns extending in the respective wale direction. Since many of composite threads, each having the metal-plated yarn as a core yarn, are distributed in the fabric structure in such a manner, it is possible to facilitate the electro-magnetic shielding property while preventing the metal-plated yarns from being visible by a human eye.

To achieve an ideally high value of the electro-magnetic shielding property, a generation source of electro-magnetic wave is preferably shielded with a metallic plate or a metallic foil. However, in a case of clothing or others which is soft in touch and provides the gas permeability and/or moisture permeability, a plate-like or foil-like material is not usable. Thus, the clothing necessarily has perforations formed through both surfaces thereof although the sizes thereof may be optional. Existence of such perforations causes the deterioration of the electro-magnetic shielding property. In other words, it is required to minimize a size of the perforation to an extent sufficient for satisfying the electro-magnetic shielding property, as well as to achieve physical properties as well as appearance required as a clothing. From such a standpoint, a size of the perforation of the clothing is preferably approximately 3 mm or less, more preferably approximately 2 mm or less regarding the electro-magnetic shielding property, according to the knowledge of the inventor of the present invention.

The present invention will be described below in more detail with reference to Examples.

EXAMPLE 1

In Example 1, the antibacterial property and the electro-magnetic shielding property were tested on warp-knit fabrics formed of composite threads according to the present invention.

A composite thread was obtained from a silver-plated yarn (X-Static®) of 30XS10 type available from Sauquoit Co., the United States (formed of polyamide multifilament 30 d/10 f which is plated with silver to become 40 d thick) used as an inlay yarn and a polyacrylic multifilament yarn (Pewlon®) available from Asahi Kasei K. K. used as a chain stitch yarn. A net warp-knit fabric (a complete structure thereof is defined by twelve courses) shown in FIG. 4 was formed while using this composite thread as yarns 31 an 33 and a polyamide filament yarn as yarns 11, 12, 13 and 21, 22, 23. A ratio of the silver-plated yarns in the warp-knit fabric was 2% by weight.

The resultant net warp-knit fabric was dyed under the following conditions:

The polyamide multifilament yarn was dyed with acidic dye for 2 hours and the polyacrylic multifilament yarn was dyed with cationic dye for 2 hours in a wince by a double-bath method, after which they were rinsed and dried.

It was observed that the resultant fabric was uniformly dyed while none of the silver-plated yarns were visible from outside.

The dyed fabric was subjected to an antibacterial test, specifications of which are as follows:

Five samples were prepared from the dyed fabric.

The antibacterial effect was measured in accordance with a shake-flask method.

Klebsiella pneumoniae was used as a bacterium to be tested.

The test results were as follows:

| | Reduction ratio of bacteria (%) |
|---|---|
| Blank test | 4.9 |
| Non-processed fabric (standard white nylon cloth) | 10.8 |
| Inventive net warp-knit fabric | 99.8 to 99.9 |

It is said that the effect is recognized if the difference in decreasing ratio of bacteria between the test sample and the non-processed fabric is 26% or more in the antibacterial test. In this respect, this Example of the warp-knit fabric according to the present invention was extremely excellent relative to the standard, which means that the composite thread containing the metal-plated yarn is effective for the antibacterial property as well as it being possible to further reduce an amount of the composite thread in the net warp-knit fabric (to lower the production cost while maintaining the actual effect of the warp-knit fabric as a result).

Next, the destaticizing ability was estimated for the dyed fabric in this Example.

Three samples were prepared from the dyed fabric and a comparative sample was prepared from a nylon lace containing no silver-plated yarn. A half-life of a static charge and an amount of a frictional static charge were measured on these samples, the results of which are as follows:

| | Sample 1 | Sample 2 | Sample 3 | Nylon lace |
|---|---|---|---|---|
| Half-life (sec) | 1.0 | 1.0 | 1.0 | 17.4 |
| Frictional static charge | 0.05 | 0.13 | 0.09 | 3.20 |

As apparent from the above results, it is understood that the destaticizing ability of the warp-knit fabric using the composite thread according to the present invention is superior to the comparative example.

In this regard, there are opinions that a product having a good destaticizing ability, especially a metal-plated yarn may cause an eruption when it is directly in contact with a human skin or cause a burn due to accumulation of electricity if infrared light or the like is irradiated thereto. However, since the metal-plated yarn is not directly in contact with a human skin according to the inventive product (a composite thread and a warp-knit fabric containing the metal-plated yarn), the above-mentioned risks are usually avoidable.

EXAMPLE 2

In Example 2, the electro-magnetic shielding property was tested on a warp-knit fabric according to the present invention wherein a metal-plated yarn is directly inserted as an inlay yarn.

A warp-knit fabric shown in FIG. 6 was prepared by using a 28G warp knit machine from a polyamide multifilament yarn of 40 d/10 f used as dyeable yarns 61 to 66 and a silver-plated yarn (X-Static®) of 30XS10 type available from Sauquoit Co., the United States (formed of polyamide multifilament 30 d/10 f which is plated with silver to be a thickness of 40 d) used as an inlay yarn. A basis weight of the resultant warp-knit fabric was approximately 60 g/m$^2$; a weight of the metal-plated yarn in the warp-knit fabric was approximately 20%, i.e., 12 g/m$^2$; and a size of a maximum perforation was approximately 3 mm.

The electro-magnetic shielding property in the range from 1 to 1000 MHZ was measured using the resultant warp-knit fabric in accordance with a KEC method. A sample of the warp-knit fabric was located between a transmitter and a receiver arranged at a distance of 10 mm in a test room conditioned at 20° C. and 40% RH. Incident energy is irradiated from upper side of the sample and measured at a position below the same.

Results are listed in Table 1.

TABLE 1

| Frequency (MHZ) | 100 | 200 | 300 | 500 | 700 | 1000 |
|---|---|---|---|---|---|---|
| Electric Field Shielding Effect (dB) | 22.5 | 22.7 | 23.1 | 24.5 | 26.0 | 25.5 |
| Electric Field Shielding Ratio (%) | 95.2 | 92.7 | 93.0 | 94.0 | 95.0 | 94.7 |
| Magnetic Field Shielding Effect (dB) | 3.6 | 7.0 | 9.1 | 11.6 | 12.8 | 12.5 |
| Magnetic Field Shielding Ratio (%) | 33.9 | 55.3 | 64.9 | 73.7 | 77.1 | 76.3 |

Figure 8:
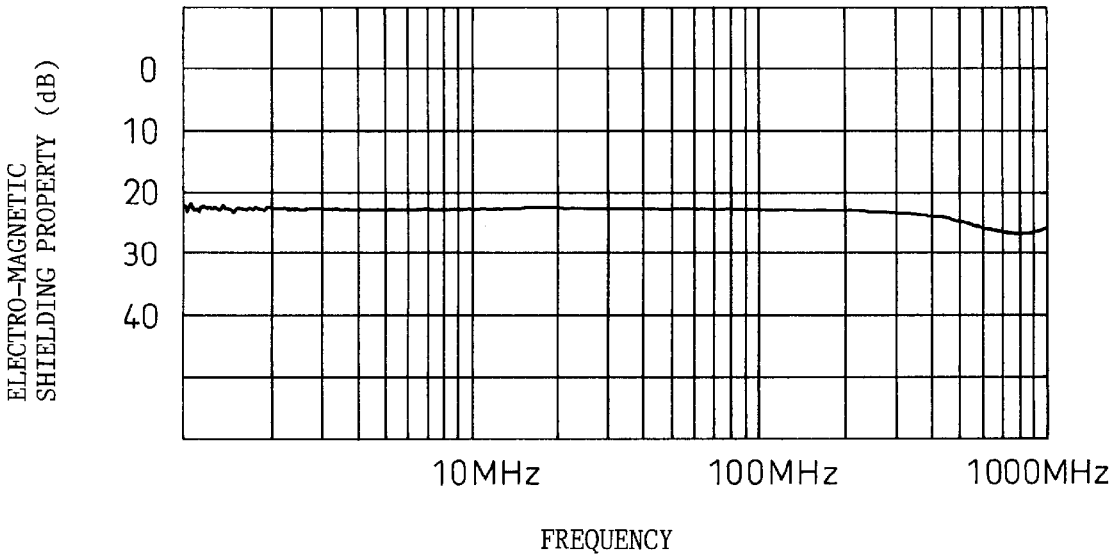
FIG. 8 is a graph illustrating the electro-magnetic shielding property of a warp-knit fabric wherein a metal-plated yarn of the present invention is arranged directly as an inlay yarn.

The electric field shielding effect cited in Table 1 is illustrated in a graph of FIG. 8.

As apparent from Table 1 and FIG. 8, according to the warp-knit fabric shown in FIG. 6 wherein the adjacent metal-plated yarns are arranged as inlay yarns to intersect each other, the electric field shielding effect is maintained generally constant in a range of 1 to 1000 MHZ. This is because the adjacent metal-plated yarns are arranged to intersect each other.

EXAMPLE 3

In Example 3, the electro-magnetic shielding property was tested on a net warp-knit fabric according to the present invention wherein the composite thread is used as an inlay yarn and which is embroidered with an embroidery thread.

A warp-knit fabric shown in FIG. 7 was prepared, using a 20G warp knit machine, from a polyamide multifilament yarn of 30 d/10 f used as dyeable yarns 81 to 86, a covering yarn formed of a polyurethane core yarn of 140 d around which is wound a polyamide multifilament yarn of 50 d/f used as elastomeric yarns 91 to 96, and a composite thread formed of a chain stitch yarn of polyamide multifilament of 70 d/24 f inserted with the above-mentioned silver-plated yarn (X-Static®) of 30XS10 type available from Sauquoit Co., the United States (formed of polyamide multifilament 30 d/10 f which is plated with silver to become 40 d thick) used as inlay yarns A1 to A3 and B1 to B3. A basis weight of the resultant warp-knit fabric was 210 g/m$^2$; a weight of the metal-plated yarn in the warp-knit fabric was approximately 12%, i.e., 25 g/m$^2$; and a size of a maximum perforation was approximately 2 mm.

The resultant warp-knit fabric was embroidered with an embroidery thread formed of three polyamide multifilament yarns of 140 d at a weight of 85 g/m$^2$. The electro-magnetic shielding property was measured on the resultant warp-knit fabric in accordance with a KEC method in a similar manner as in Example 2.

TABLE 2

| Frequency (MHZ) | 100 | 200 | 300 | 500 | 700 | 1000 |
|---|---|---|---|---|---|---|
| Electric Field Shielding Effect (dB) | 40.7 | 33.8 | 26.3 | 17.2 | 11.2 | 38.3 |
| Electric Field Shielding Ratio (%) | 99.1 | 98.0 | 95.2 | 86.2 | 72.5 | 38.3 |
| Magnetic Field Shielding Effect (dB) | 2.3 | 4.1 | 4.9 | 5.4 | 5.4 | 11.5 |
| Magnetic Field Shielding Ratio (%) | 23.3 | 37.6 | 43.1 | 46.3 | 46.3 | 73.4 |

Figure 9:
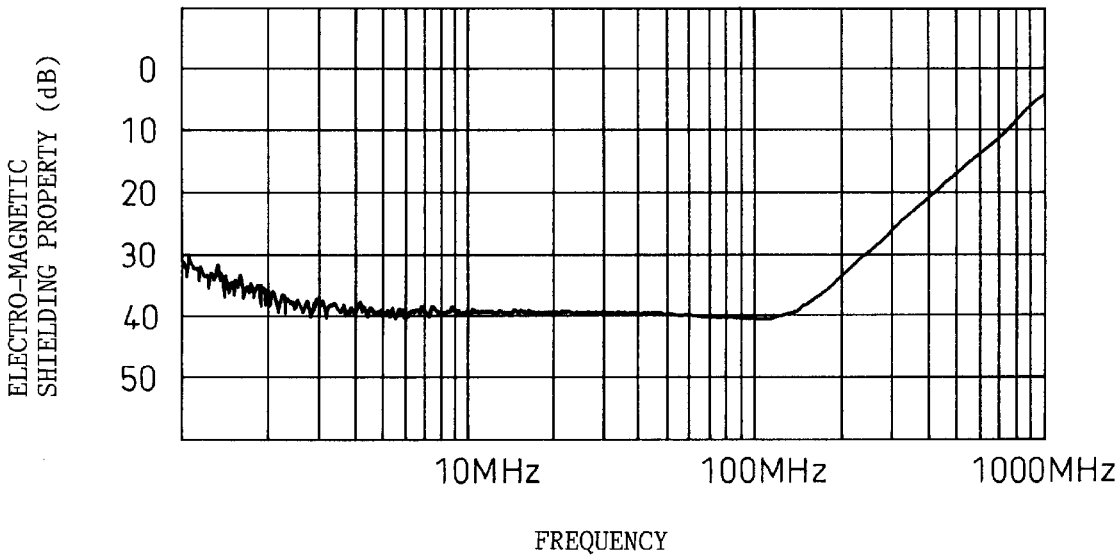
FIG. 9 is a graph illustrating the electro-magnetic shielding property of a warp-knit fabric containing a composite thread of the present invention.

The electric field shielding effect cited in Table 2 is illustrated in a graph of FIG. 9.

As apparent from Table 2 and FIG. 9, according to the warp-knit fabric shown in FIG. 7 wherein the composite thread of the present invention is used, the electric field shielding effect is reduced in a frequency range exceeding 200 MHZ. It is thought that this is because the metal-plated yarns in the warp-knit fabric are separated from each other not to be in contact via the chain stitch yarns formed of dyeable yarns whereby the metal-plated yarns are not electrically connected to each other. The reason why the electro-magnetic shielding property in a frequency range lower than 100 MHZ is superior to Example 2 is that an amount of the metal-plated yarn in the warp-knit fabric is as large as approximately 25 g/m$^2$ which is about double that in Example 1 and also the size of the perforation is smaller.

INDUSTRIAL APPLICABILITY

Since the composite thread, a fabric or a weft-knit product formed of the composite thread contains a metal-plated yarn, the antibacterial effect and the electro-magnetic shielding effect are excellent. Also, since the surface of the composite thread is covered with a chain stitch yarn formed of a dyeable yarn, a uniform dyeing as good as that resulted from a usual dyeable yarn can be expected. Since the metal-plated yarn is concealed in the warp-knit fabric, the appearance of the surface of the warp-knit fabric is equal to a knit fabric formed of a usual dyeable yarn, wherein the composite thread is uniformly distributed throughout the warp-knit fabric. As a result, a relatively inexpensive product excellent in the antibacterial property and the electro-magnetic shielding property can be obtained. These inventive products also have an antistatic ability.

What is claimed is:

1. A composite thread comprising a chain stitch yarn formed of a dyeable yarn and an inlay yarn inserted as a core yarn into the chain stitch yarn, characterized in that the inlay yarn contains at least one metal-plated yarn.

2. A composite thread defined by claim 1, characterized in that the metal-plated yarn is a silver-plated yarn.

3. A composite thread defined by claim 2, characterized in that the silver-plated yarn is a synthetic monofilament or multifilament yarn plated with silver on a surface of each of single filaments in a range from 20% to 40% by weight.

4. A composite thread defined by claim 2, characterized in that the silver-plated yarn is a synthetic staple fiber spun yarn plated with silver on a surface of each of the staple fibers in a range from 20% to 40% by weight.

5. A fabric selected from a group consisting of a woven fabric, a circular knit fabric and a warp-knit fabric, characterized in that the composite thread defined by claim 1 is used for forming at least part of the fabric.

6. A weft-knit product selected from a group including socks, stockings, and sweaters, characterized in that the composition thread defined by claim 1 is used for forming at least part of the weft-knit product.

7. A warp-knit fabric formed of at least two kinds of yarns, characterized in that a metal-plated yarn is used as at least one of the yarns forming the warp-knit fabric, wherein the metal-plated yarn is inserted into the warp-knit fabric so as to be invisible to a human eye from an outer surface of the warp-knit fabric.

8. A warp-knit fabric as defined by claim 5, characterized in that the yarns forming the warp-knit fabric include at least two groups of the metal-plated yarns arranged to intersect each other in the warp-knit fabric.

* * * * *